US006612105B1

(12) United States Patent
Voigt et al.

(10) Patent No.: US 6,612,105 B1
(45) Date of Patent: Sep. 2, 2003

(54) UNIFORM GAS DISTRIBUTION IN ION ACCELERATORS WITH CLOSED ELECTRON DRIFT

(75) Inventors: Arnold W. Voigt, Bellevue, WA (US); David Q. King, Woodinville, WA (US); Kristi H. De Grys, Bellevue, WA (US); Roger M. Myers, Woodinville, WA (US)

(73) Assignee: Aerojet-General Corporation, Redmond, WA (US)

( * ) Notice: Subject to any disclaimer, the term of this patent is extended or adjusted under 35 U.S.C. 154(b) by 0 days.

(21) Appl. No.: 09/674,463

(22) PCT Filed: Jun. 3, 1999

(86) PCT No.: PCT/US99/12403

§ 371 (c)(1),
(2), (4) Date: Jan. 29, 2001

(87) PCT Pub. No.: WO00/02811

PCT Pub. Date: Jan. 20, 2000

Related U.S. Application Data

(60) Provisional application No. 60/092,269, filed on Jul. 10, 1998, and provisional application No. 60/088,164, filed on Jun. 5, 1998.

(51) Int. Cl.[7] ..... H01J 1/52

(52) U.S. Cl. ..... 60/202; 313/362.1; 315/111.81; 315/111.91

(58) Field of Search ..... 60/202, 203.1; 315/111.81, 111.91; 313/362.1

(56) References Cited

U.S. PATENT DOCUMENTS 3,117,416 A * 1/1964 Harries ..... 60/202
3,328,624 A * 6/1967 Webb ..... 60/202

(List continued on next page.)

FOREIGN PATENT DOCUMENTS

JP 01077764 3/1989

(List continued on next page.)

OTHER PUBLICATIONS

A.I. Morozov et al., "Plasma Accelerator With Closed Electron Drift and Extended Acceleration Zone," *Soviet Physics—Technical Physics* , vol. 17, No. 1, pp. 38–45 (1972).

(List continued on next page.)

*Primary Examiner*—Ted Kim
(74) *Attorney, Agent, or Firm*—Christensen O'Connor Johnson Kindness PLLC

(57) ABSTRACT

A system for uniformly distributing propellant gas in a Hall-effect thruster (10) (HET) includes an anode (42, 42') and a porous material gas distributor (60, 89) (PMGD). The porous material (120) may be porous metal or porous ceramic. Propellant gas is directed from a supply to the PMGD for distribution into a gas discharge region (16) of the HET (10). The gas flows through the porous material (120) of the PMGD and out of the PMGD's exit surface (71) into the annular gas discharge region (16). The PMGD has an average pore size, pore density and thickness that are optimized to control the flow of the gas at the desired flow rate and distribution uniformity at a relatively short distance downstream from the PMGD. This feature allows HET to be short, significantly decreasing susceptibility to vibration problems encountered during vehicle launch. The PMGD can include a shield (79, 80) for preventing contaminants from traveling upstream from the gas discharge region from adhering to the porous metal. The shield may be integrated into the PMGD or be a separate shield. In addition, the shield may be perforated so as to allow gas to pass through the shield to further decrease the distance needed to achieve uniform gas distribution. Alternatively, the exit surface (71) of the porous metal may be oriented to face perpendicularly from the gas discharge path out of the HET, which significantly reduces the probability of contaminants adhering to the exit surface.

25 Claims, 7 Drawing Sheets

U.S. PATENT DOCUMENTS

| | | | | | |
|---|---|---|---|---|---|
| 3,359,733 | A | * | 12/1967 | Forbes | 60/202 |
| 3,371,489 | A | * | 3/1968 | Eckhardt | 60/202 |
| 3,735,591 | A | | 5/1973 | Burkhart | |
| 4,277,939 | A | | 7/1981 | Hyman, Jr. | |
| 4,783,595 | A | * | 11/1988 | Seidl | 250/423 R |
| 4,862,032 | A | | 8/1989 | Kaufman et al. | |
| 5,218,271 | A | | 6/1993 | Egorov et al. | |
| 5,357,747 | A | | 10/1994 | Myers et al. | |
| 5,359,258 | A | | 10/1994 | Arkhipov et al. | |
| 5,475,354 | A | | 12/1995 | Valentian et al. | |
| 5,581,155 | A | | 12/1996 | Morozov et al. | |
| 5,646,476 | A | * | 7/1997 | Aston | 60/202 |
| 5,763,989 | A | | 6/1998 | Kaufman | |
| 5,798,602 | A | | 8/1998 | Gopanchuk et al. | |
| 5,845,880 | A | | 12/1998 | Petrosov et al. | |
| 5,847,493 | A | | 12/1998 | Yashnov et al. | |
| 6,075,321 | A | * | 6/2000 | Hruby | 313/359.1 |
| 6,150,764 | A | * | 11/2000 | Hruby et al. | 313/362.1 |
| 6,208,080 | B1 | * | 3/2001 | King et al. | 60/202 |
| 6,215,124 | B1 | * | 4/2001 | King | 60/202 |

FOREIGN PATENT DOCUMENTS

| | | |
|---|---|---|
| SU | 1715183 | 4/1994 |
| WO | WO 97/37127 | 10/1997 |
| WO | WO 97/37517 | 10/1997 |

OTHER PUBLICATIONS

A.I. Morozov et al., "Effects of the Magnetic Field on a Closed–Electron–Drift Accelerator," *Soviet Physics—Technical Physics*, vol. 17, No. 3, pp. 482–487 (1972).

H.R. Kaufman, "Technology of Closed–Drift Thrusters," *AIAA Journal*, vol. 23, No. 1, pp. 78–87 (1995).

V.M. Gavryushin et al., "Effect of the Characteristics of a Magnetic Field on the Parameters of an Ion Current at the Output of an Accelerator With Closed Electron Drift," *American Institute of Physics*, pp. 505–507 (1981).

C.O. Brown et al., "Further Experimental Investigations of a Cesium Hall–Current Accelerator," *AIAA Journal*, vol. 3, No. 5, pp. 853–859 (1965).

S.N. Kulagin et al., "Some Results of Investigation of Anode Design Influence on Anode Layer Thruster Characteristics," *24th International Electric Propulsion Conference*, Moscow, Russia, pp. 1–5 (Sep. 19–23, 1995).

R.X. Meyer, "A Space–Charge–Sheath Electric Thruster," *AIAA Journal*, vol. 5, No. 11, pp. 2057–2059 (1967).

* cited by examiner

UNIFORM GAS DISTRIBUTION IN ION ACCELERATORS WITH CLOSED ELECTRON DRIFT

CROSS REFERENCE TO RELATED APPLICATIONS

This application is the national phase filing of international application No. PCT/US99/12403, filed Jun. 3, 1999, which claims the benefit of the filing dates of the following earlier filed U.S. applications: application Ser. No. 09/192,039, filed Nov. 13, 1998 now abandoned, application Ser. No. 09/251,530, filed Feb. 17, 1999; now U.S. Pat. No. 6,215,124 provisional application No. 60/088,164, filed Jun. 5, 1998; provisional application No. 60/092,269, filed Jul. 10, 1998.

FIELD OF THE INVENTION

The present invention relates to Hall effect thrusters and, more particularly, to a system for providing the gas with a uniform distribution to a discharge region of the Hall effect thruster.

BACKGROUND INFORMATION

Ion accelerators with closed electron drift, also known as "Hall effect thrusters" (HETs), have been used as a source of directed ions for plasma assisted manufacturing and for spacecraft propulsion. Representative space applications are: (1) orbit changes of spacecraft from one altitude or inclination to another; (2) atmospheric drag compensation; and (3) "stationkeeping" where propulsion is used to counteract the natural drift of orbital position due to effects such as solar wind and the passage of the moon. HETs generate thrust by supplying a propellant gas to an annular gas discharge region. Such region has a closed end which includes an anode and an open or exit end through which the gas is discharged. The propellant gas is typically introduced into the annular gas discharge region in the vicinity of the anode and, in some systems, through the anode itself. Free electrons are introduced from a cathode into the vicinity of the exit end of the annular gas discharge region. In accordance with the Hall effect, the electrons drift circumferentially in the annular discharge region by a generally radially extending magnetic field in combination with a longitudinal electric field. The electrons collide with the propellant gas atoms, creating ions. Because the ions are generally orders of magnitude larger in mass that electrons, the motion of the ions is not significantly affected by the magnetic field. As a result, the longitudinal electric field accelerates the ions outward through the exit end of the annular gas discharge region, generating thereby a reaction force to propel the spacecraft.

One of the parameters that affects the performance of an HET is the uniformity of the gas propellant as it is introduced into the annular gas discharge region. Researchers believe that when the neutral propellant gas (i.e., before ionization) is concentrated in regions near the anode, electron mobility toward the anode is enhanced. This effect results in locally increased electron current to the anode, which undesirably increases power dissipation and heating of the anode. Nonuniform azimuthal gas distribution in the annular discharge region tends to cause nonuniform azimuthal electron density. It can be shown that the nonuniform azimuthal electron density causes a reduction of the Hall parameter $\beta$, which is generally undesirable in HET applications. The Hall effect and the Hall parameter are well known in the art of HETs.

In some conventional HETs, baffles are used to increase uniformity of the gas as the gas is introduced into the gas discharge region. These baffle systems increase gas distribution uniformity to some degree but, of course, greater uniformity is generally desirable. In addition, in some conventional baffle systems, the axial length of the gas discharge region must be made long enough to allow for uniform distribution of the gas after leaving the baffle system. However, the increased axial length of the gas discharge region tends to make the HET susceptible to problems caused by the extreme vibrations and accelerations encountered during launch of the spacecraft into orbit. To avoid these problems, these systems generally increase the thickness and strength of the HET structures to withstand the vibrations. This solution tends to undesirably increase the cost and weight of the HET.

Other conventional systems may use gas injectors to increase gas distribution uniformity. The gas injectors have a large number of injector holes that are uniformly spaced and manufactured to exacting tolerances to achieve high uniformity. However, such injectors are relatively difficult and costly to manufacture. Accordingly, there is a need for a low cost propellant gas distribution system that provides high gas distribution uniformity while being low in size and weight.

SUMMARY

In accordance with the present invention, a system for uniformly distributing propellant gas in a HET is provided. In one embodiment, the system is part of an anode assembly that includes an anode and a gas distributor. Propellant gas is directed from a supply to the anode assembly for distribution into the gas discharge region of the HET. In one aspect of the present invention, the gas distributor includes a porous metal "nozzle" with an input surface and an output surface. The input surface of the nozzle receives the propellant gas from the supply. Due to the difference in pressure of the propellant gas at the input and output surfaces of the porous metal nozzle, the propellant gas flows through the porous metal nozzle and out of the exit surface into the annular gas discharge region. The porous metal nozzle has an average pore size and thickness that is optimized to control the flow of the propellant gas from the input surface to the output surface at the desired flow rate, pressure drop, and distribution uniformity. Unlike the aforementioned conventional baffle systems which typically achieve gas distribution uniformity at a significant distance from the baffle exit, the porous metal achieves highly uniform gas output flow virtually directly from the exit surface of the gas distributor. This feature allows gas discharge region to be shorter in length compared to conventional systems, allowing the HET to be a low profile compact device that is less susceptible to vibration problems encountered during vehicle launch. Moreover, the porous metal is manufactured to have the desired average pore size, pore distribution and thickness at a cost that is significantly less than the cost to manufacture the previously described conventional injector system.

In a further aspect of the present invention, the gas distributor includes a shield and/or baffle for preventing contaminants from adhering to all or most of the exit surface of the porous metal nozzle. In one embodiment, a shield is implemented with non-porous material and is positioned in the gas discharge region downstream from the anode assembly. In this way, contaminants directed upstream toward the anode assembly are blocked by the shield. Without the shield, the contaminants may clog the pores of the porous metal gas distributor, which may decrease the uniformity of the propellant gas flow into the gas discharge region. The shield interrupts the uniformity of the propellant gas flow and must be positioned far enough upstream of the ion creation zone to diffuse the propellant gas into uniform density again. In a further refinement, the shield may have circular or elongated perforations so as to allow propellant gas to pass through the anti-clogging structure to further decrease the distance needed to achieve uniform gas distribution. The perforations are larger than the pore size of the porous metal gas distributor so that the contaminants do not easily clog the perforations. Although it may be possible for contaminants to flow through the perforations and clog small areas of the porous metal gas distributor, the small areas of clogged pores do not significantly affect the uniform gas distribution provided by the porous metal.

In an alternative embodiment, the anti-clogging structure may be implemented by coating a surface of the porous metal gas distributor that faces generally downstream into the gas discharge chamber. This coating is non-porous and is configured to leave uncovered a surface of the porous metal gas distributor that does not face downstream into the gas discharge region (e.g., the uncovered surface faces in a direction perpendicular to the gas discharge region). That is, the exit surface of the nozzle faces in a radial direction relative to the net gas flow into the gas discharge region. Thus, the probability of contaminants directed upstream from the gas discharge region toward the anode assembly adhering to the uncovered surface of the porous metal gas distributor is significantly reduced.

BRIEF DESCRIPTION OF THE DRAWINGS

The foregoing aspects and many of the attendant advantages of this invention will become more readily appreciated by reference to the following detailed description, when taken in conjunction with the accompanying drawings, listed below.

DETAILED DESCRIPTION

Figure 1:
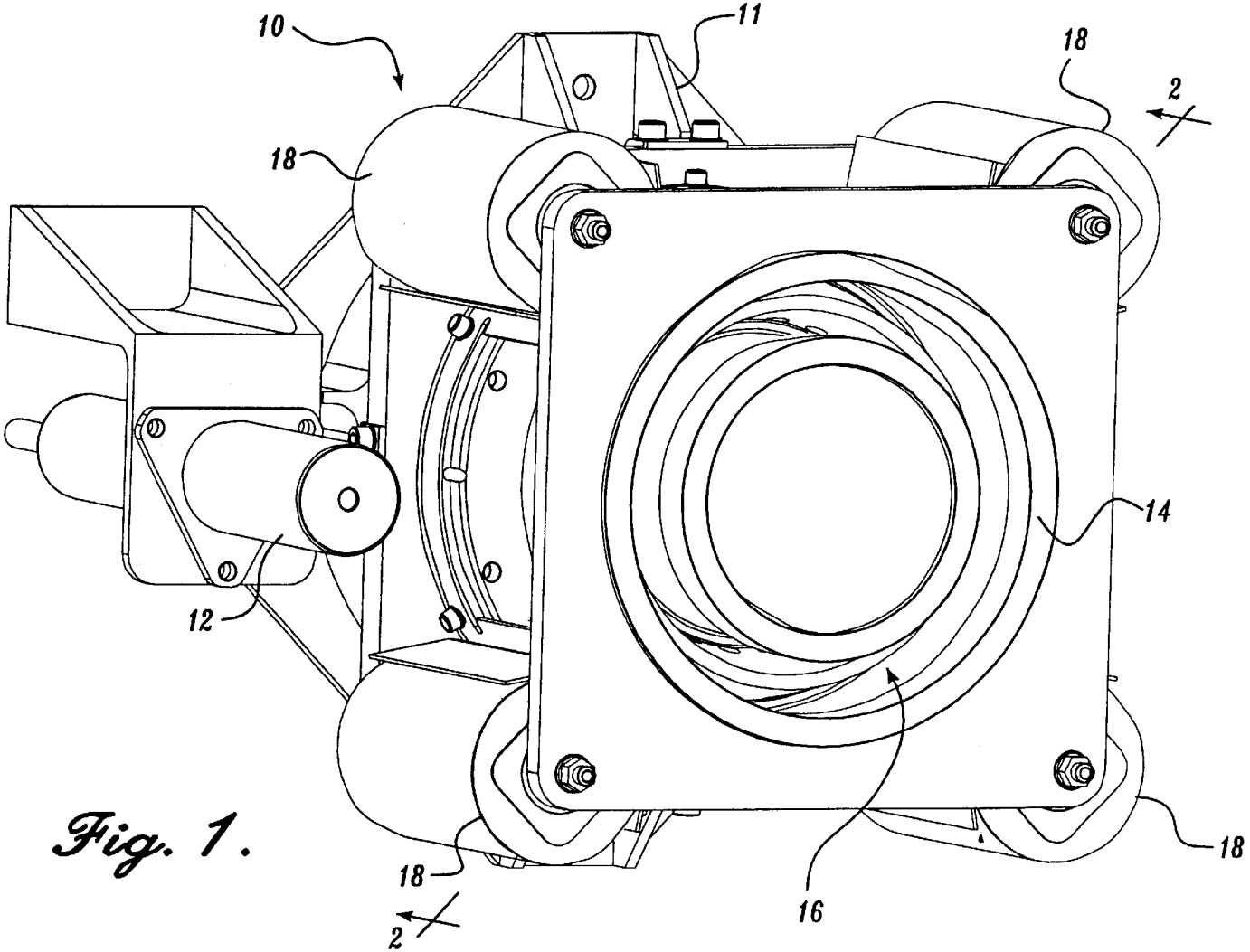
FIG. 1 is a somewhat diagrammatic top, exit end perspective of an ion accelerator with closed electron drift of a representative type with which the present invention is concerned.

FIG. 1 illustrates a representative Hall effect thruster (HET) of the type with which the present invention is concerned as it may be configured for spacecraft propulsion. HET 10 is carried by a spacecraft-attached mounting bracket 11. Few details of the HET are visible from the exterior, although the electron-emitting cathode 12, exit end 14 of the annular discharge chamber or area 16 and outer electromagnets 18 are seen in this view. As described in more detail below, propulsion is achieved by ions accelerated outward, toward the viewer and to the right as viewed in FIG. 1, from the annular discharge region 16.

Figure 2:
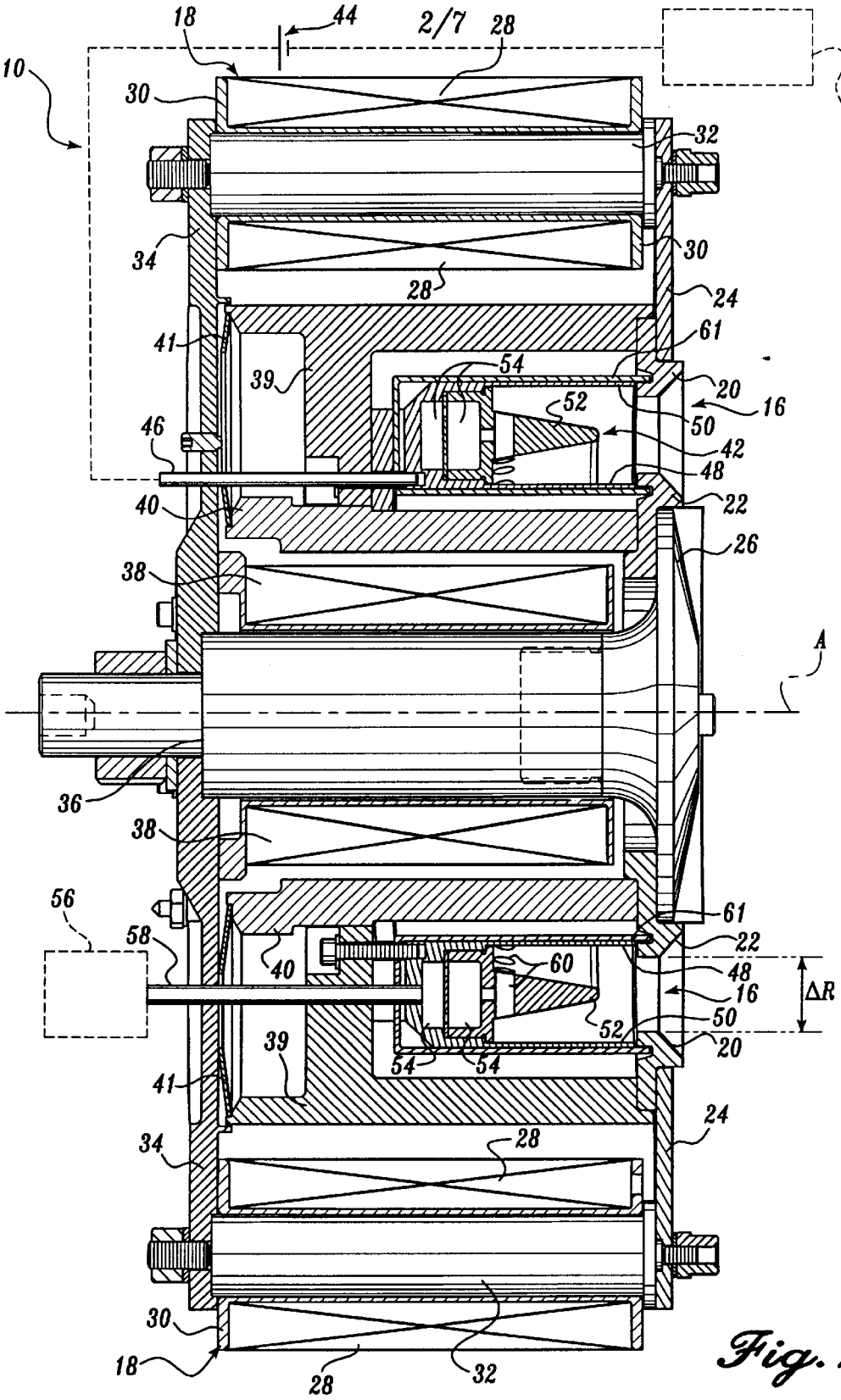
FIG. 2 is a somewhat diagrammatic longitudinal section along line 2—2 of FIG. 1.

More detail is seen in the sectional view of FIG. 2. The endless annular ion formation and discharge region 16 is formed between an outer ceramic ring 20 and an inner ceramic ring 22. The ceramic is electrically insulative, and sturdy, light, and erosion-resistant. It is desirable to create an essentially radially-directed magnetic field in the discharge area, between an outer ferromagnetic pole piece 24 and an inner ferromagnetic pole piece 26. In the illustrated embodiment, this is achieved by the outer electromagnets 18 having windings 28 on bobbins 30 with internal ferromagnetic cores 32. At the exit end of the accelerator, the cores 32 are magnetically coupled to the outer pole piece 24. At the back or closed end of the accelerator, the cores 32 are magnetically coupled to a ferromagnetic backplate 34 which is magnetically coupled to a ferromagnetic center core or stem 36. Stem 36 is magnetically coupled to the inner pole 26. These elements constitute a continuous magnetic path from the outer pole 24 to the inner pole 26, and are configured so that the magnetic flux is more or less concentrated in the exit end portion of the annular discharge region 16. Additional magnetic flux can be provided by an inner electromagnet having windings 38 around the central core 36.

Structural support is provided by an outer structural body member 39 of insulative and nonmagnetic material bridging between the outer ceramic ring 20 and outer pole 24 at one end and the backplate 34 at the other end. A similar inner structural body member 40 extends generally between the inner ring 22 and backplate 34. A Belleville spring 41 is interposed between the back ends of the structural members 39 and 40 and the backplate 34, primarily to allow for thermal expansion and contraction of the overall thruster frame.

The cathode 12, shown diagrammatically in FIG. 2, is electrically coupled to the accelerator anode 42 which is located upstream of the exit end portion of the annular gas discharge region 16 defined between the outer and inner ceramic rings 20 and 22. The electric potential between the cathode 12 and anode 42 is achieved by power supply and conditioning electronics 44, with the potential conveyed to the anode by way of one or more electrically conductive rods 46 extending through the backplate 34 of the HET 10. In the illustrated embodiment, the anode includes electrically conductive inner and outer walls 48 and 50 and an annular protruding portion 52 between the inner and outer walls. The tip of the protruding portion extends downstream close to the upstream edges of the exit rings 20 and 22.

The rear of the anode has one or more gas distribution chambers 54. Propellant gas, such as xenon, from a gas supply system 56 is fed to the chambers 54 through one or more supply conduits 58. In accordance with the present invention, the propellant gas is then distributed to the discharge region 16 through a porous metal gas distributor 60. The porous metal gas distributor 60 is described in more detail below in conjunction with FIGS. 3 through 12.

Another magnetically permeable element is provided, a specially designed flux bypass component 61 having circumferential sides inside the inner anode wall 48 and outside the outer anode wall 50, as well as a rear portion or web behind the anode 42 to connect the inner and outer sides of the bypass component.

In general, electrons from the cathode 12 are drawn toward the discharge region 16 by the difference in electrical potential between the cathode and the anode 42. The electrons collide with atoms of the propellant gas, forming ions and secondary electrons. The secondary electrons continue toward the anode, and the ions are accelerated in a beam directed generally outward from the discharge area, creating a reaction force which may be used to accelerate a spacecraft.

The magnetic field between the outer and inner poles 24 and 26 has several important properties, including controlling the behavior of the electrons. As electrons are drawn toward the anode, they execute a complex motion composed primarily of cyclotron motion, crossed field drift, and deflection due to occasional collisions. Electrons are considered highly magnetized in that they execute a helical motion at the so called gyro frequency $\omega_b$=qB/m which is much greater than the frequency of collisions with walls or unlike particles, $\nu_c$, where q is the electron charge, B is the magnitude of the magnetic field, and m is the mass of an electron. The ratio of the gyro frequency to collision frequency $\nu_c$ is called the Hall parameter $\beta=\omega_b/\nu_c$. Superimposed on this helical motion is a drift arising from a combination of crossed electric and magnetic fields. This drift is perpendicular to the direction of the electric field and perpendicular to the magnetic field. Since the electric field extends longitudinally and the magnetic field extends radially, the drift is induced in a generally circumferential direction in the annular discharge area 16. The electron current due to this drift is called the Hall current and is given by $$j_h = qn_e\frac{\overline{E}\times\overline{B}}{|\overline{B}|^2},$$

where $n_e$ is the electron density, $\overline{E}$ is the electric field vector and $\overline{B}$ is the magnetic field vector. The electron current perpendicular to $\overline{B}$ can be shown to be $$j_\perp = qn_e\frac{\mu_e}{\beta^2+1}\left(E_\perp + \frac{1}{qn_e}\nabla_\perp p_e\right)$$

where $\mu_e$ is the scalar electron mobility and $p_e$ is the electron pressure. The ratio of the Hall current to perpendicular can also be shown to be $$\frac{j_h}{j_\perp} = \beta.$$

The electric field for this device is generally perpendicular to the magnetic field. This arises from the mobility of electrons being different in the directions parallel vs. perpendicular to the magnetic field. Parallel electron motion is unimpeded save for collisions and electric field forces. Perpendicular motion is limited to a cyclotron orbit deflected by infrequent collisions. As a result, the ratio of parallel to perpendicular mobility is $$\frac{1}{\beta^2+1}$$

which for $\beta$=100 effectively shorts out potential variations in the direction of the magnetic field. Hence, curves defining the direction of the magnetic field approximate equipotential contours. Thus, the electric field is effectively perpendicular to the magnetic field in Hall accelerators.

Another important property is the uniformity of density and magnetic field in the drift velocity direction. For a circular accelerator, this is the azimuthal direction, i.e., generally circumferentially in the discharge region 16. Fluctuations in neutral density result in electron density variations. As the Hall current passes through regions of varying density, electrons are accelerated and decelerated, increasing motion across the magnetic field. This results in effective saturation of the Hall parameter. Variations in magnetic field strength in the drift direction have a similar effect. For instances, a 5% variation in electron density can result in an effective Hall parameter limited to a maximum of about 20.

The magnetic field strength is adjusted so that the length of the electron gyro radius, also known as the Larmor radius, $$r_g = \frac{V_\perp}{\omega_b},$$

where $v\perp$ is the velocity component of electrons perpendicular to the magnetic field, is smaller than the radial width $\Delta R$ of the discharge region 16. The ion gyro radius is larger by the ratio of the ion mass to electron mass, a factor of several thousand. Hence, the radius of curvature of ions is large compared to the device dimensions and ions are accelerated away from the anode relatively unaffected by the magnetic field.

The magnetic field shapes the electric potential which in turn affects the acceleration of particles. A concave (upstream) and convex (downstream) shape has lens-like properties that focus and defocus the ion beam respectively. More specifically, ions tend to be accelerated in a direction perpendicular to a tangent of a line of equal potential. If this line is convex as viewed from upstream to downstream, ions are accelerated toward the center of the discharge area and a focusing effect occurs. With such focusing properties, this feature of the magnetic system is called a plasma lens.

Figure 3:
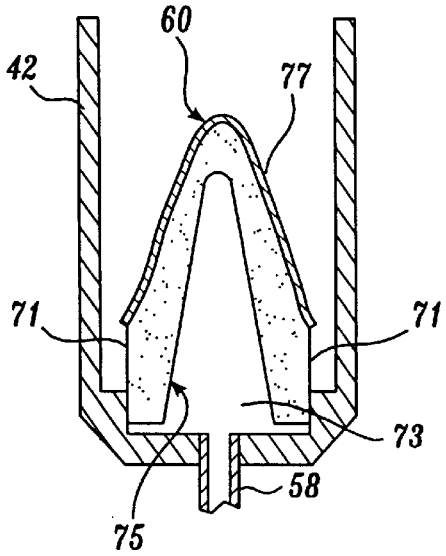
FIG. 3 is a longitudinal section of an anode assembly that includes a wedge-shaped porous metal gas distributor, according to one embodiment of the present invention.

FIG. 3 illustrates porous metal gas distributor 60 having a wedge-shaped cross-section, according to one embodiment of the present invention. In this embodiment, gas distributor 60 is configured to be used in an HET of the type shown in FIGS. 1 and 2.

Gas distributor 60 is coupled to the output end of supply conduit 58. Gas distributor 60 includes an exit surface 71 located near the area at which supply conduit 58 is coupled to gas distributor 60. Exit surface 71 is oriented in a generally transverse or radial direction relative to the longitudinal axis of HET 10 (FIG. 1). Consequently, the propellant gas initially flows out of gas distributor 60 in a direction that is generally radial from the longitudinal axis of HET 10 (FIG. 1). This type of gas distributor is referred to herein as a radial flow gas distributor.

Gas distributor 60 is fabricated from a porous metal. The porous metal is formed into a ring with a wedge-shaped cross-section using conventional porous metal fabrication techniques. These conventional porous metal fabrication techniques are also used to fabricate the pores in the porous metal to have a desired average size. In this embodiment, the porous metal is formed from a powder of non-magnetic stainless steel. Stainless steel is advantageously used to match coefficients of expansion of other structures in HET 10 (FIG. 1). Generally, the pore size and pore density is related to the size of the powder, with an increase in powder size resulting in a larger porosity (and increased flow through the porous material). Such porous material is commercially available from SSI Sintered Specialties, Janesville Wis., GKN Sinter Metal, Terryville, Conn., and Mott Industrial, Farmington, Conn. These commercial sources can often provide the porous metal material in any desired shape, such as the annular wedge-shaped configuration of this embodiment. In alternative embodiments, in which gas distributor 60 does not function as an anode and is a separate structure from anode 42, gas distributor 60 may be made of a non-conductive material such as ceramic.

Gas distributor 60 also includes a cavity or plenum 73 that forms an input surface 75 of the gas distributor 60. The size and shape of plenum 73 is selected so as to achieve a desired thickness between the input and exit surfaces of gas distributor 60. The configuration of the input and exit surfaces, along with the thickness of the porous metal between those surfaces forms, in effect, a nozzle for distributing propellant gas. In one embodiment, the porous metal was made from five micron powder with a thickness of about 1.5 millimeters between the input and exit surfaces.

In addition, gas distributor 60 includes a non-porous finish 77 covering those portions of the porous metal gas distributor that are exposed to contaminants flowing upstream from the gas discharge region. Thus, finish 77 helps define exit surface 71. Finish 77 is formed by depositing a film of metal onto the desired portions of the gas distributor. For example, conventional sputtering, vapor deposition or plasma spraying techniques may be used to form finish 77. Alternatively, mechanical surface deformation may be used to seal pore openings to form finish 77.

In operation, propellant gas enters plenum 73 from supply conduit 58. In this embodiment, the propellant gas is xenon gas, which has a viscosity of about $4.5\times10^{-4}$ poise in the expected operating conditions. The propellant gas then passes from input surface 75 through the porous metal of gas distributor 60 to exit surface 71 and out into gas discharge region 16 (FIG. 2). The porous metal of gas distributor 60 serves as a flow restriction, which helps increase uniformity. In particular, the gas distributor 60 is ring shaped to correspond to the annular gas discharge region of HET 10 (FIG. 1). The flow restriction provided by the porous metal gas distributor is essentially uniform at all points of the "ring." Assuming the pressure of the propellant gas is essentially uniform at all points of the input surface of gas distributor 60, then the porous metal will provide uniform flow of propellant gas out of exit surface 71. The propellant gas would then diffuse downstream from exit surface 71 into annular discharge region 16. Although exit surface 71 is radially oriented, the propellant gas has a uniform axial flow (i.e., from exit surface 71 to annular discharge region 16) because the propellant gas has an essentially uniform distribution from exit surface 71. In particular, radially gas flow is axially redirected by anode 42, so that axial gas flow may not be uniformly distributed, initially. However, the relatively low pressure in gas discharge region 16 (FIG. 2) combined with the initial uniform radial gas flow allows the axial gas flow to reach uniform distribution a relatively short distance (i.e., about five to ten millimeters downstream from exit surface 71).

As a result of the quickly achieved uniform axial gas flow, the axial length of gas discharge region 16 (FIG. 2) can be significantly shorter than the aforementioned conventional gas distribution systems. This feature allows HET 10 (FIG. 1) to be significantly more compact, which advantageously allows HET 10 (FIG. 1) to be lighter in weight and size than conventional HETs. The shorter length allows further decreases in size and weight because the additional structural strength required to withstand the intense accelerations and vibrations experienced during launch are significantly reduced in a compact HET.

In general, the pore size, pore density, thickness and exit surface area would depend on the propellant gas being used, the flow rate desired for the propellant gas into the gas discharge region, and the pressure difference desired between the input and exit surfaces of the gas distributor. In this embodiment, the pore size, pore distribution, porous metal thickness and exit surface area are configured to achieve a flow rate of about ten milligrams of xenon gas with the gas number density at the input surface being about $1\times10^{24}/m^3$ and the gas number density in gas discharge region 16 (FIG. 2) being about $4\times10^{19}/m^3$. An increase in average pore size, pore density or exit surface area would tend to increase the flow rate and decrease pressure difference, while an increase in porous metal thickness or propellant gas viscosity would tend to decrease flow rate and increase pressure difference. Porous metal fabrication techniques are generally significantly less costly and time consuming than the aforementioned conventional systems that use injectors.

Because exit surface 71 is essentially parallel to the longitudinal axis of HET 10 (FIG. 1), contaminants traveling upstream from gas discharge region 16 (FIG. 2) are less likely to adhere to exit surface 71. More specifically, as HET 10 (FIG. 1) operates, the plasma formed in gas discharge region 16 (FIG. 2) erodes dielectric portions of HET 10 that define part of gas discharge region 16. Because the gas is rarefied, some of the particles or contaminants eroded from these dielectric portions of HET 10 (FIG. 1) can travel upstream towards gas distributor 60. These particles can clog the pores of a porous metal, thereby decreasing the uniformity of gas flow through the porous metal. However, because exit surface 71 of gas distributor 60 is oriented parallel to the general direction of the dielectric portions of HET 10 (FIG. 1), the contaminants are unlikely to strike exit surface 71.

The wedge-shaped cross section of the porous metal gas distributor can be used to help shape the electric field in the region near gas distributor 60. It is thought that by electrically connecting gas distributor 60 to anode 42, the potential of gas distributor 60 is essentially equal to the anode potential, thereby influencing the electric field in the vicinity of gas distributor 60. This effect is described in U.S. patent application Ser. No. 09/107,343 entitled "HALL FIELD PLASMA ACCELERATOR" by V. Hruby filed on Jun. 30, 1998. In embodiments that use non-conductive porous material in fabricating gas distributor 60, finish 77 can be formed from conductive material and electrically connected to anode 42.

Figure 4:
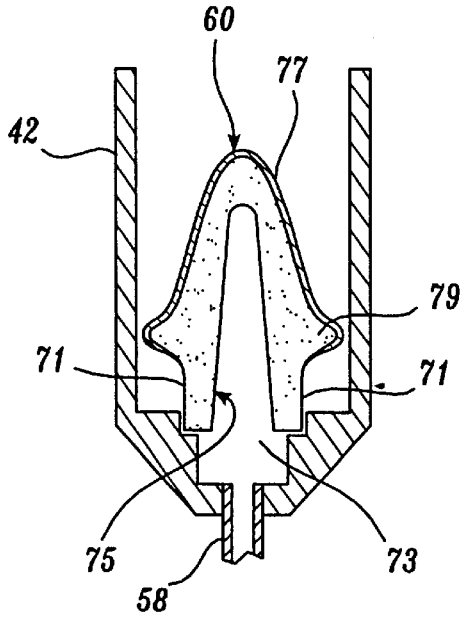
FIG. 4 is a longitudinal section of an anode assembly that includes a wedge-shaped radial flow porous metal gas distributor with an integrated contamination shield, according to one embodiment of the present invention.

FIG. 4 is a cross-section of an anode assembly that includes wedge-shaped porous metal radial flow gas distributor 60, according to another embodiment of the present invention. This embodiment of gas distributor 60 is substantially similar to the embodiment of FIG. 3, except that in this embodiment, gas distributor 60 includes a skirt or overhang 79 positioned downstream from exit surface 71. Skirt 79 helps to further prevent contaminants from reaching exit surface 71.

Figure 5:
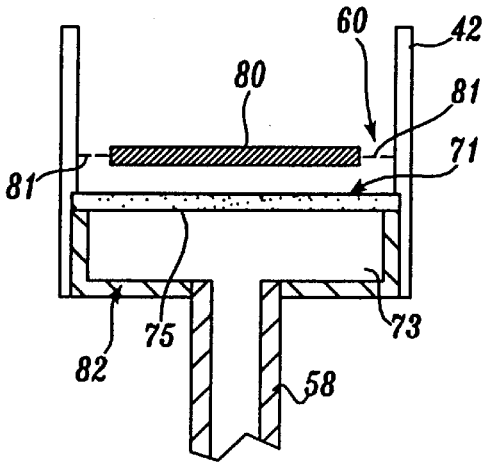
FIG. 5 is a longitudinal section of an anode assembly that includes a flat porous metal gas distributor with a shield, according to one embodiment of the present invention.

FIG. 5 is a longitudinal section of an anode assembly that includes porous metal gas distributor 60 having a flat configuration with a shield 80 and a plenum structure 82, according to one embodiment of the present invention. In this embodiment, the flat ring-shaped porous metal structure and plenum structure 82 form plenum 73 communicating between gas conduit 58 and input surface 75. In particular, the flat ring-shaped porous metal structure is oriented with exit surface 71 facing downstream and input surface 75 facing gas conduit 58. Shield 80 is positioned downstream from and aligned with exit surface 71. The shield can be held in position by thin radial spokes 81 shown in broken lines, which extend between the peripheral edges of the shield and the conductive inner and outer walls of the anode. In this configuration, shield 80 prevents most of the contaminants that travel upstream from gas discharge region 16 (FIG. 2) from hitting exit surface 71. However, shield 80 leaves some portions along the edges of the flat ring-shaped porous metal structure uncovered to allow flow of propellant gas into gas discharge area 16. These exposed areas are susceptible to clogging, but due to relatively large area of exit surface 71 that is protected by shield 80, any such clogging does not significantly affect the performance of HET 10 (FIG. 1). Because the initial flow of propellant gas from exit surface 71 is generally directed parallel to the longitudinal axis of HET 10 (FIG. 1), this embodiment of gas distributor 60 is referred to herein as an axial flow gas distributor.

Shield 80 does interfere to some degree with uniform gas distribution as the propellant gas flows toward gas discharge region 16 (FIG. 2). That is, the effect of shield 80 is similar to the effect of anode 42 in the radial flow embodiment described above in conjunction with FIG. 3. As described above, because of the initial uniform gas distribution from exit surface 71, the flow towards gas discharge region 16 (FIG. 2) becomes uniformly distributed within a relatively short distance downstream from shield 80. Thus, shield 80 helps ensure gas flow with uniform distribution from exit surface 71 over the lifetime of HET 10 (FIG. 1) by preventing upstream moving contaminants from clogging the porous metal at exit surface 71.

Figure 6:
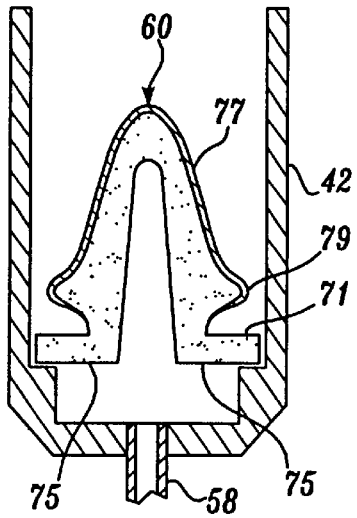
FIG. 6 is a longitudinal section of an anode assembly that includes a wedge-shaped axial flow porous metal gas distributor with an integrated contamination shield, according to another embodiment of the present invention.

FIG. 6 is a cross-section of an anode assembly that includes wedge-shaped porous metal axial flow gas distributor 60, according to another embodiment of the present invention. This embodiment of gas distributor 60 is substantially similar to the embodiment of FIG. 4, except that in this embodiment, exit surface 71 faces downstream so as to initially have axial gas flow. Skirt or overhang 79 is positioned downstream from exit surface 71, which helps to prevent contaminants from reaching exit surface 71. Skirt 79 causes a relatively minor disruption in the uniformity of the gas density, which is quickly made uniform by diffusion of the propellant gas.

Figure 7:
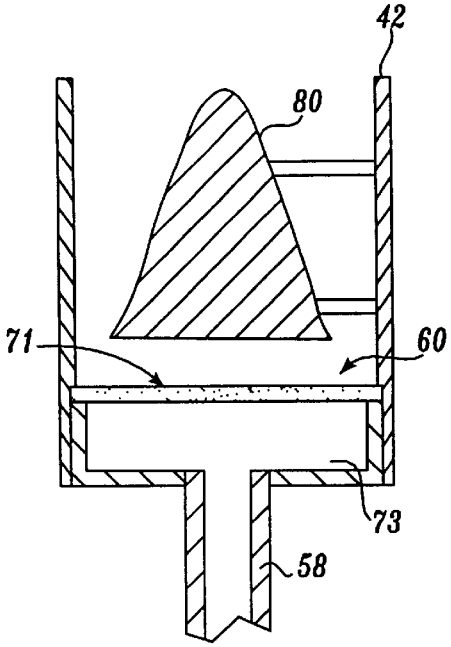
FIG. 7 is a longitudinal section of an anode assembly that includes a flat porous metal gas distributor with wedge-shaped shield electrode.

FIG. 7 is a longitudinal section of an anode assembly that includes a flat porous metal gas distributor 60 with a wedge-shaped shield electrode 80. This embodiment is substantially similar to the embodiment of FIG. 5, except that in this embodiment shield 80 is wedge-shaped and electrically connected to anode 42. In this embodiment, the wedge-shape and conductivity of shield 80 provides the benefits of the embodiment of FIGS. 3 and 4.

Figure 8:
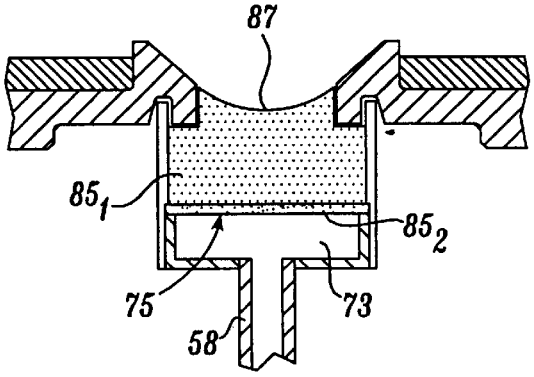
FIG. 8 is a longitudinal section of an anode assembly that includes a porous metal gas distributor having a curved surface facing the gas discharge region, according to one embodiment of the present invention.

FIG. 8 is a longitudinal section of an anode assembly that includes a combined anode/gas distributor (combined anode) 85, according to one embodiment of the present invention. This embodiment is similar to the embodiment of FIG. 5 except that shield 80 is replaced with an downstream portion $\mathbf{85}_1$ that is positioned in contact with the flat ring-shaped porous metal portion of gas distributor 80. The flat ring-shaped porous metal portion of gas distributor 80 is referred to in FIG. 7 as gas distributor portion $\mathbf{85}_2$. Downstream portion $\mathbf{85}_1$ and gas distributor portion $\mathbf{85}_2$ form combined anode 85, which is maintained at the anode potential to function as both a gas distributor and the anode 42 (FIG. 5).

In this embodiment, downstream portion $\mathbf{85}_1$ is also made from porous metal to allow propellant gas to flow from gas distributor portion $\mathbf{85}_2$ and out of exit surface 87 into gas discharge region 16 (FIG. 2). Downstream portion $\mathbf{85}_1$ is preferably formed from non-magnetic material, such as austenitic stainless steel, whereas upstream portion $\mathbf{85}_2$ and anode 42 are preferably formed from magnetically permeable material such as ferritic stainless steel.

Downstream portion $\mathbf{85}_1$ has pore size and pore density that provides relatively little flow resistance, thereby allowing upstream portion $\mathbf{85}_2$ to effectively control the flow rate and density of the gas flow into gas discharge region 16 (FIG. 2). Portion $\mathbf{85}_1$ is preferably conductive so that it can serve as the anode. Downstream portion $\mathbf{85}_1$ has a curved exit surface 87 facing gas discharge region 16 (FIG. 2). The curvature of curved exit surface 87 is configured to match the curvature of the magnetic field lines (which approximate lines of equipotential) of the previously described plasma lens created by HET 10 (FIG. 1) during operation. This feature advantageously allows the propellant gas to be ionized at essentially the same, well defined potential, which improves the focusing of the plasma lens. In addition, the composition and shape of combined anode 85 allows the gas discharge to form an anode layer ionization mechanism instead of a magnetic layer ionization mechanism.

Figure 9:
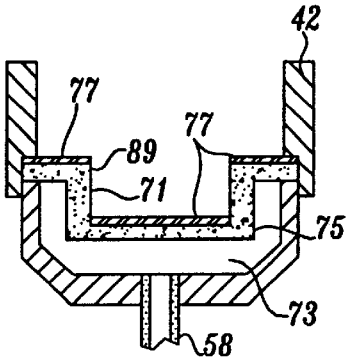
FIG. 9 and FIG. 10 are corresponding longitudinal sections of anode assemblies that include porous metal gas distributors with radial gas flow, according to additional embodiments of the present invention.

FIG. 9 is a longitudinal section of an anode assembly that includes a porous metal radial flow gas distributor 89, according to another embodiment of the present invention. In this embodiment, gas distributor 89 has a U-shaped cross-section, with non-porous finish 77 on the surfaces that face downstream. Finish 77 can be formed as described above in conjunction with FIG. 3. Gas distributor 89 is substantially similar to the gas distributor of FIG. 5, except that shield 80 is omitted and exit surface 71 is oriented to face in direction generally perpendicular to the longitudinal axis of HET 10 (FIG. 1) and toward the inner surface of the opposite anode sidewall. Consequently, the initial propellant gas flow from gas distributor 89 is radially "inward" (i. e. , inward from the sidewalls of the anode structure) instead of "outward" as in the gas distributor of FIG. 3. As in the gas distributor of FIG. 3, the perpendicular orientation of exit surface 71 helps to avoid clogging by upstream traveling contaminants.

Figure 10:
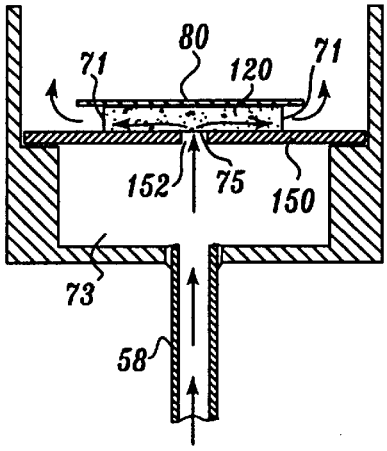

In the modification shown in FIG. 10, the gas supply conduit 58 leads to a plenum 73 of rectangular cross-section. The major portion of the outlet side of the plenum is closed by an annular plate 150 having a series of center perforations or outlet slots 152. Such perforations or slots lead to the intake side 75 of a porous metal gas diffuser 120 which extends radially inward and outward beyond the opposite edges of the slots 152. The surface of the porous metal gas diffuser opposite the inlet surface 75 can be coated with nonporous material but preferably is covered by a thin solid sheet shield 80 which extends radially inward and outward beyond the inner and outer edges of the porous metal gas diffuser. Such inner and outer edges of the porous metal gas diffuser form the outwardly facing outlet surfaces 71 for the gas distributor.

Figure 11:
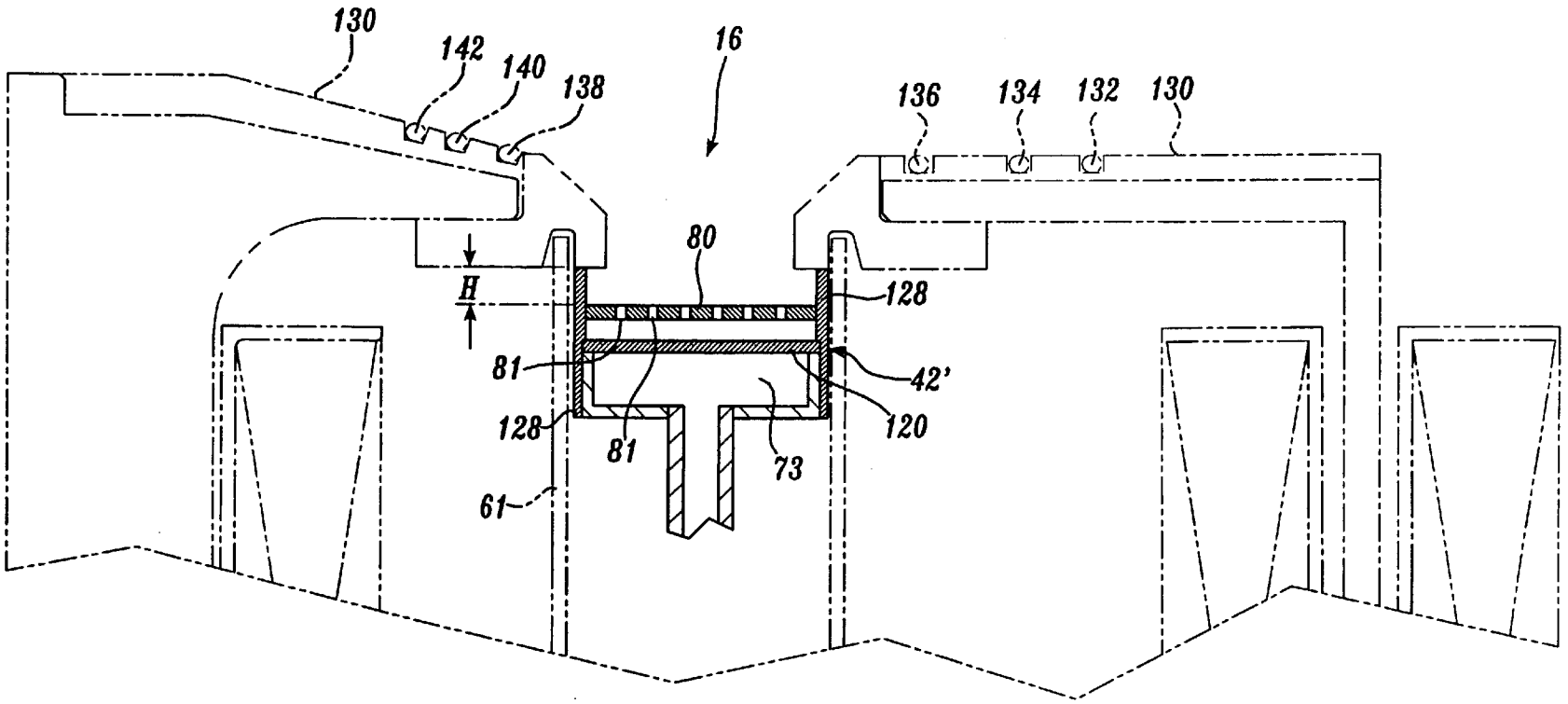
FIG. 11 is a diagrammatic, fragmentary, sectional view of an accelerator of the type with which the present invention is concerned using an anode of the general type shown in FIG. 5 but with perforations in the downstream shield or baffle.

FIG. 11 shows an anode 42' of the general type described above with reference to FIG. 5 incorporated in an HET of the general type shown in FIGS. 1 and 2. Anode 42' includes a rear plenum section 73. A porous metal gas distributor plate 120 extends across the front of the plenum to achieve a uniform distribution of gas exiting the plenum into the ionization and acceleration area 16. Plate 120 is ring shaped and substantially closes the gas distribution area leading to the ionization and acceleration zone 16. The shield 80 is positioned downstream from plate 120. The shield is a thin flat ring with circular perforations 81 to allow propellant gas to flow through shield 80 so that the gas distribution will be more uniform closer downstream from shield. The perforations are about one millimeter in diameter, but can range from about 0.5 millimeter to about 4 millimeters, provided the open area fraction of the perforations is limited to about twenty to fifty percent. In addition, the perforation diameter is selected to achieve a ratio of one-to-ten when compared to the distance between the downstream surface of shield 80 and the exit end of anode 42 (indicated as "H" in FIG. 10). Although the perforations allow some upstream traveling contaminants to hit some portions of exit surface 71 and clog the pores of these unshielded areas, the remaining shielded areas of exit surface 71 are sufficient to achieve the desired gas flow, uniformity, and gas density in gas discharge region 16 (FIG. 2).

The walls 128 of the anode 42' are electrically conductive, and it is preferred that the porous gas distribution plate 120 also be electrically conductive. Thus the walls and the plate are at the same potential (the anode potential). The modified anode 42' can be essentially surrounded by a cage shunt 61 to achieve a desired shaping of the magnetic field in the exit area of the HET. Alternatively, or additionally, the porous gas distribution plate 120 can be formed of a material which is both electrically conductive and magnetically permeable, as can the anode walls 128, to obtain the desired shaping with or without the use of a cage shunt.

An appropriate nonmagnetic but electrically conductive material for the porous gas distribution plate is austenitic or martensitic stainless steel, and a representative magnetically permeable material is ferritic stainless steel. The pore size, pore density, thickness and exit surface area of the gas distribution plate 120 will depend on the same factors as previously described.

Other than the anode 42', the parts of the HET of FIG. 11 are shown diagrammatically because they may conform to other embodiments of HETs. Preferably the HET having the modified anode 42' will have the outer pole surfaces coated with an insulative layer 130. One or more external electrode rings 132, 134, 136, 138, 140, 142 may be provided, biased to potentials different than the anode or cathode potentials for additional magnetic and electric field shaping, although the anode in accordance with the present invention is equally usable with pole faces not having the additional electrodes.

Figure 12:
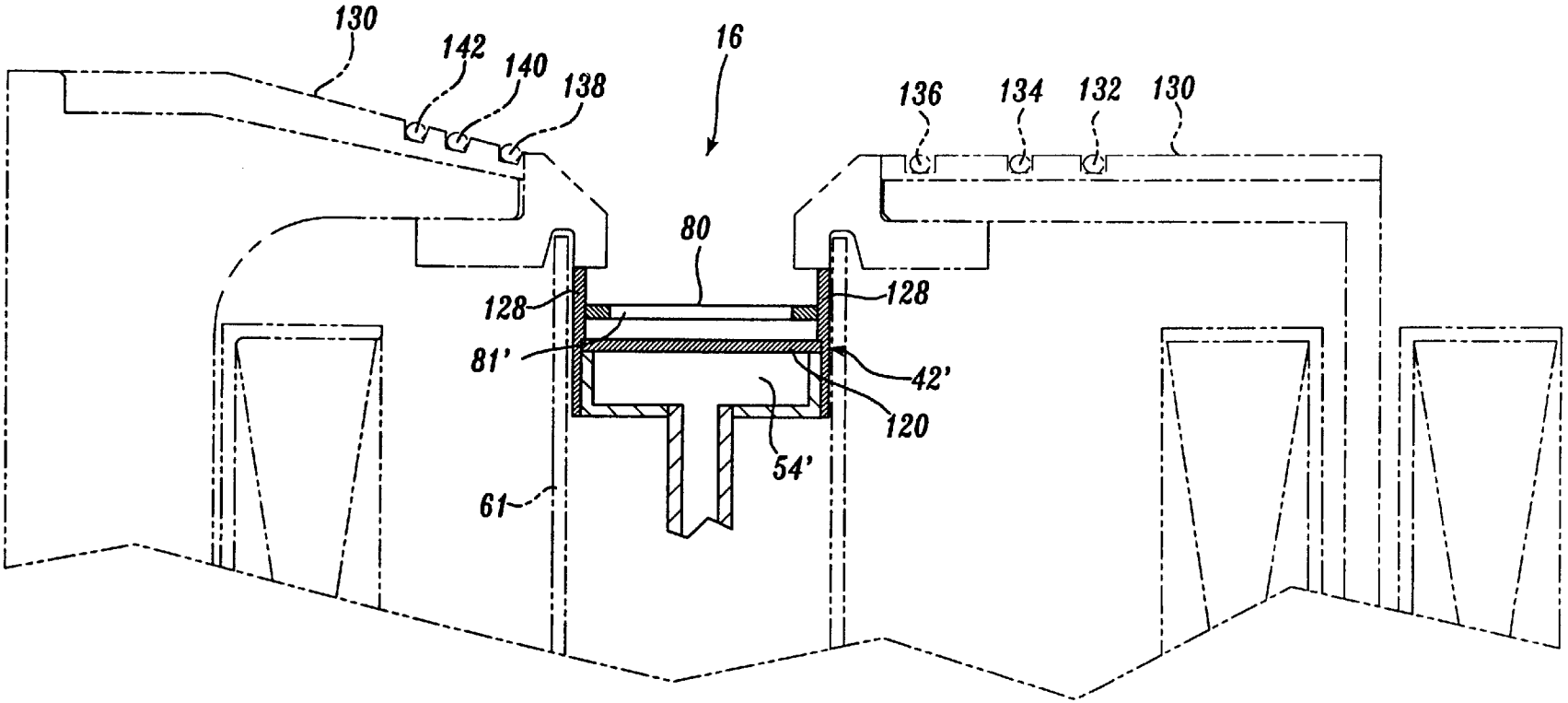
FIG. 12 is a diagrammatic, fragmentary, sectional view corresponding to FIG. 11 but with a modified anode having a downstream shield or baffle with elongated perforations or slots.
Figure 13:
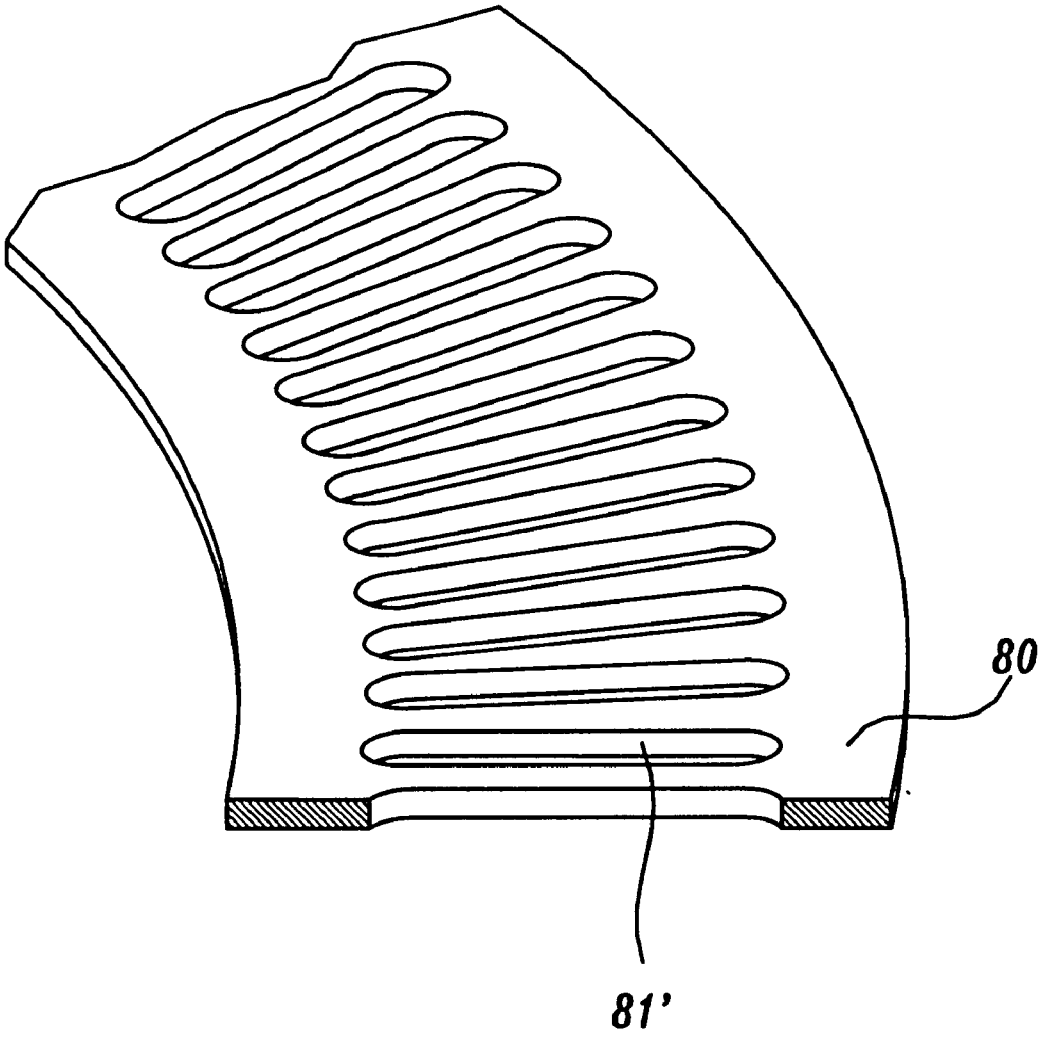
FIG. 13 is a fragmentary perspective illustrating the slotted baffle of the embodiment of FIG. 12.

With reference to FIG. 12 and FIG. 13, in an alternative embodiment the downstream shield or baffle 80 is provided with generally radially extending, elongated slots 81' rather than circular perforations. Each slot extends from almost the inner anode wall to almost the outer anode wall, and is of a width of about 2 millimeters, preferably 0.5 to 4 millimeters. It is still preferred that the open area of the slots constitute no more than about 20 to about 50 percent of the total area of the baffle 80, preferably about 30 percent, and that the width of each slot be selected to achieve a ratio of 1 to 10 when compared to the distance between the downstream surface of the baffle and the exit end of the anode. Depending on the application, the baffle could be magnetic material to influence the shaping of the magnetic field in the area of the exit end of the thruster, or it could be nonmagnetic material so as not to interfere with magnetic field shaping by other components such as a shunt 61.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A method of distributing a propellant gas into a gas discharge region of a Hall-effect thruster (HET), the HET further including a gas supply, a gas conduit, and a gas distributor, characterized by making the gas distributor having a nozzle of porous material, the porous material of the nozzle having an average pore size, a pore density, an input surface, an exit surface and a thickness profile between the input and exit surfaces, and further characterized by the method comprising the steps of:

providing the nozzle so that the porous material of the nozzle has a predetermined average pore size, a predetermined pore density, a predetermined area of the exit surface of the nozzle, and a predetermined thickness profile so as to achieve a flow of the propellant gas through the nozzle with a predetermined flow rate and a predetermined pressure drop into the gas discharge region;

providing during operation of the HET the propellant gas from the gas supply to the nozzle so that the propellant gas has a predetermined input gas density near the input surface of the nozzle, wherein the propellant gas passes through the input surface to the exit surface of the nozzle with a net flow into the gas discharge region at the predetermined flow rate and predetermined gas density; and configuring the nozzle so that contaminants flowing from the gas discharge region toward the nozzle do not adhere to the exit surface of the nozzle.

2. The method of claim 1 wherein the step of configuring the nozzle so that contaminants flowing from the gas discharge region toward the nozzle do not adhere to the exit surface further comprises including a shield proximate to the nozzle so that the shield lessens contaminants traveling from the gas discharge region from striking the exit surface of the nozzle.

3. The method of claim 2 wherein the nozzle includes an overhang to serve as the shield.

4. The method of claim 4 wherein the step of configuring the nozzle so that contaminants flowing from the gas discharge region toward the nozzle do not adhere to the exit surface of the nozzle further comprises configuring the exit surface of the nozzle to not face in the direction of the gas discharge region.

5. The method of claim 4 wherein the exit surface of the nozzle is substantially flat and oriented to be substantially parallel to the net flow of propellant gas into the gas discharge region.

6. The method of claim 2 wherein the shield includes perforations, the perforations being larger in size than the pores of the porous material of the nozzle.

7. The method of claim 6 wherein the shield is formed into a ring with a wedge-shaped cross-section.

8. The method of claim 6 further comprising maintaining the shield at an anode potential.

9. The method of claim 1 wherein the nozzle is configured so that the propellant gas has an initial net flow out of the exit surface of the nozzle in a direction substantially perpendicular to the net flow of propellant into the gas discharge region.

10. The method of claim 1 wherein the gas distributor further comprises a curved portion coupled to the exit surface of the nozzle, the curved portion being comprised of porous material with a curved exit surface, the curved exit surface facing the gas discharge region and having a curvature substantially matching a curvature of a magnetic field line near the curved exit surface of the curved portion during operation of the HET.

11. The method of claim 10 wherein the porous material of the curved portion is configured to have a gas flow rate that is higher than the gas flow rate of the nozzle.

12. A system for distributing a propellant gas into a gas discharge region of a Hall-effect thruster (HET), the system comprising:

a gas conduit configured to supply propellant gas from the gas supply at a predetermined input gas density; and gas distributor means coupled to the gas supply for distributing propellant gas from the gas supply to the gas discharge region of the HET, characterized by the gas distributor means including a nozzle of porous material, the porous material of the nozzle having a predetermined average pore size, a predetermined pore density, an input surface, an exit surface with a predetermined area, and a predetermined thickness profile between the input and exit surfaces, the gas distributor being configured to prevent contaminants traveling from the gas discharge region toward the nozzle from adhering to the exit surface of the nozzle, and further characterized by the gas distributor means being configured to allow, during operation of the HET, propellant gas from the gas conduit to flow through the input surface to the exit surface of the nozzle with a net flow into the gas discharge region at a predetermined flow rate and a predetermined gas density.

13. A gas distributor for distributing a propellant gas into a gas discharge region of a Hall-effect thruster (HET), the HET having a gas supply, the gas distributor being characterized by:

a nozzle formed from a porous material, the porous material of the nozzle having a predetermined average pore size, a predetermined pore density, an input surface, an exit surface with a predetermined area, and a predetermined thickness profile between the input and exit surfaces; and a plenum coupled to the nozzle and the gas supply, the plenum communicating with the input surface of the nozzle, further characterized by the gas distributor being configured during operation of the HET to allow propellant gas from the gas supply to flow into the plenum and through the input surface to the exit surface of the nozzle, the propellant gas flowing out of the exit surface of the nozzle with a net flow into the gas discharge region at a predetermined flow rate and a predetermined gas density, the gas distributor being configured to prevent contaminants traveling from the gas discharge region toward the nozzle front adhering to the exit surface of the nozzle.

14. The gas distributor of claim 13 wherein the porous material of the nozzle comprises a porous metal.

15. The gas distributor of claim 13 wherein the porous material of the nozzle comprises a porous ceramic.

16. The gas distributor of claim 13 further comprising a shield positioned between the exit surface of the nozzle and the gas discharge region, wherein the shield blocks contaminants traveling from the gas discharge region from striking the exit surface.

17. The gas distributor of claim 16 wherein the nozzle includes an overhang that serves as the shield.

18. The gas distributor of claim 16 wherein the shield includes perforations, the perforations being larger in size than the pores of the porous material of the nozzle.

19. The gas distributor of claim 16 wherein the shield is formed as a ring with a wedge-shaped cross-section.

20. The gas distributor of claim 16 wherein the shield is maintained at an anode potential.

21. The gas distributor of claim 13 wherein the gas distributor is configured so that the exit surface of the nozzle does not face in the direction of the gas discharge region.

22. The gas distributor of claim 21 wherein the exit surface of the nozzle is substantially flat and oriented to be substantially parallel to the net flow of propellant gas into the gas discharge region.

23. The gas distributor of claim 21 wherein the nozzle is configured so that the propellant gas has an initial net flow out of the exit surface of the nozzle in a direction substantially perpendicular to the net flow of propellant into the gas discharge region.

24. The gas distributor of claim 13 wherein the gas distributor further comprises a curved portion coupled to the exit surface of the nozzle, the curved portion being comprised of porous material with a curved exit surface, the curved exit surface facing the gas discharge region and having a curvature substantially matching a curvature of a magnetic field line near the curved exit surface of the curved portion during operation of the HET.

25. The gas distributor of claim 24 wherein the porous material of the curved portion is configured to have a gas flow rate that is higher than the gas flow rate of the nozzle.

* * * * *

UNITED STATES PATENT AND TRADEMARK OFFICE

CERTIFICATE OF CORRECTION

PATENT NO. : 6,612,105 B1
DATED : September 2, 2003
INVENTOR(S) : A. W. Voigt et al.

It is certified that error appears in the above-identified patent and that said Letters Patent is hereby corrected as shown below:

Title page,
Item [75], Inventors, "Bellevue," should read -- Bothell, --
Item [60], Related U.S. Application Data, "Jun. 5, 1998." should read -- Jun. 5, 1998; and application No. 09/192,039, filed on Nov. 13, 1998, now abandoned, and application serial No. 09/251,530, filed on Feb. 17, 1999, now Pat. No. 6,215,124. --
Item [56], References Cited, OTHER PUBLICATIONS, "*Physics—Technical Physics* ," should read -- *Physics—Technical Physics*, --

Column 14,
Line 11, "front" should read -- from --

Signed and Sealed this

Third Day of February, 2004

JON W. DUDAS
*Acting Director of the United States Patent and Trademark Office*